US009198553B2

(12) United States Patent
Policicchio

(10) Patent No.: US 9,198,553 B2
(45) Date of Patent: Dec. 1, 2015

(54) CLEANING ARTICLE WITH UPSTANDING ELASTIC PANEL

(75) Inventor: Nicola John Policicchio, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 567 days.

(21) Appl. No.: 13/416,420

(22) Filed: Mar. 9, 2012

(65) Prior Publication Data

US 2013/0232706 A1 Sep. 12, 2013

(51) Int. Cl.

*A47L 13/12* (2006.01)
*A47L 13/16* (2006.01)
*A47L 13/38* (2006.01)

(52) U.S. Cl.

CPC ..... *A47L 13/16* (2013.01); *A47L 13/12* (2013.01); *A47L 13/38* (2013.01)

(58) Field of Classification Search

CPC ..... A47L 13/12; A47L 13/20; A47L 13/38; A47L 13/16
USPC ..... 15/115, 209.1, 226, 227, 229.1, 229.3, 15/229.4, 229.7, 229.8
See application file for complete search history.

(56) References Cited

U.S. PATENT DOCUMENTS

| | | | |
|---|---|---|---|
| 823,725 | A | 6/1906 | Hayden et al. |
| 4,145,757 | A | 3/1979 | Bonnie |
| 4,506,404 | A | 3/1985 | Clay |
| 5,536,555 | A | 7/1996 | Zelazoski et al. |
| 5,953,784 | A | 9/1999 | Suzuki et al. |
| 6,513,184 | B1 | 2/2003 | Brown et al. |
| 6,550,092 | B1 | 4/2003 | Brown et al. |
| 6,773,424 | B2 | 8/2004 | Heyrman et al. |
| 6,813,801 | B2 | 11/2004 | Tanaka et al. |
| 6,963,591 | B2 | 11/2005 | Tulloch et al. |
| 6,984,615 | B2 | 1/2006 | Kenmochi et al. |
| 7,228,587 | B2 | 6/2007 | Tanaka et al. |
| 7,231,685 | B2 | 6/2007 | Tanaka et al. |
| 7,234,193 | B2 | 6/2007 | Tanaka et al. |
| 7,234,914 | B2 | 6/2007 | Usab et al. |
| 7,237,296 | B2 | 7/2007 | Tanaka et al. |
| 7,237,297 | B2 | 7/2007 | Tanaka et al. |
| 7,243,391 | B2 | 7/2007 | Tanaka et al. |
| 7,251,851 | B2 | 8/2007 | Lin et al. |
| 7,302,729 | B2 | 12/2007 | Tanaka et al. |

(Continued)

FOREIGN PATENT DOCUMENTS

| | | | |
|---|---|---|---|
| EP | 0945251 | A1 | 9/1999 |
| JP | 2011-104111 | A * | 6/2011 |

OTHER PUBLICATIONS

U.S. Appl. No. 13/416,334, filed Mar. 9, 2012, Policicchio.

(Continued)

*Primary Examiner* — Randall Chin
(74) *Attorney, Agent, or Firm* — Larry L. Huston; Steven W. Miller

(57) ABSTRACT

A cleaning article optionally removably attachable to a handle and comprising tow fibers and at least one sheet joined together in a layered construction. The cleaning article is generally planar. An elastically contracted panel is joined to the plane of the fibers or the sheet. The elastic causes the panel to contact and extend outwardly from the plane of the cleaning article. By extending outwardly from the plane of the cleaning article, the panel can directly entangle the fibers or disrupt the sheet, to promote fluffing of the tow fibers.

17 Claims, 4 Drawing Sheets

(56) References Cited

U.S. PATENT DOCUMENTS

| | | | | |
|---|---|---|---|---|
| 7,302,730 | B2 | 12/2007 | Tanaka et al. | |
| 7,334,287 | B2 | 2/2008 | Tanaka et al. | |
| 7,435,243 | B2 | 10/2008 | Miyamoto | |
| 7,566,671 | B2 | 7/2009 | Hoadley et al. | |
| 7,918,839 | B2 | 4/2011 | Ehrnsperger et al. | |
| 8,151,402 | B2 * | 4/2012 | Takabayashi et al. | 15/229.3 |
| 8,225,453 | B2 * | 7/2012 | Yamada | 15/229.1 |
| 2004/0016074 | A1 | 1/2004 | Tanaka | |
| 2005/0198757 | A1 | 9/2005 | Gavney, Jr. et al. | |
| 2006/0016036 | A1 | 1/2006 | Tanaka et al. | |
| 2006/0101601 | A1 | 5/2006 | Fujiwara | |
| 2007/0084006 | A1 | 4/2007 | Policicchio | |
| 2010/0319152 | A1 | 12/2010 | Pzizepasniak | |
| 2011/0131746 | A1 | 6/2011 | Policicchio et al. | |
| 2011/0154598 | A1 | 6/2011 | Yamada | |

OTHER PUBLICATIONS

U.S. Appl. No. 13/416,526, filed Mar. 9, 2012, Cooper.
U.S. Appl. No. 13/416,486, filed Mar. 9, 2012, Policicchio.
International Search Report Dated May 23, 2013; 10 pages.

* cited by examiner

CLEANING ARTICLE WITH UPSTANDING ELASTIC PANEL

FIELD OF THE INVENTION

The present invention relates to cleaning articles, and more particularly to cleaning articles comprising tow fibers and the like.

BACKGROUND OF THE INVENTION

Various cleaning articles have been created for dusting and light cleaning. For example, cloth rags and paper towels used dry or wetted with polishing and cleaning compositions have been used on relatively flat surfaces. But, rags and paper towels are problematic for reasons such as hygiene (the user's hand may touch chemicals, dirt or the surface during cleaning), reach (it may be difficult to insert the user's hand with the rag or paper towel into hard-to-reach places) and inconvenience (cleaning between closely-spaced articles typically requires moving the articles).

To overcome the problems associated with using rags and paper towels, various dust gathering devices having feathers, lamb's wool, and synthetic fiber brushes have been utilized for more than a century, as illustrated by U.S. Pat. No. 823,725 issued in 1906 to Hayden. Such dust gathering devices can be expensive to manufacture, and as such are designed to be cleaned and reused. One problem associated with a reusable dust gathering device is that such dust gathering devices may not hold or trap dust very well. Soiled, reusable devices are typically cleaned via shaking or through other mechanical agitation. This process is not entirely satisfactory as it requires an extra step during, interrupting and/or following the cleaning process. Furthermore, the attempted restoration of the device may not be successful, allowing redeposition of the previously collected dust.

To address the problems experienced with reusable dust gathering devices, disposable dust gathering devices have been developed which have limited re-usability. These disposable dust gathering devices may include brush portions made of synthetic fiber bundles, called tow fibers, attached to a sheet as shown in 2010/0319152. Or the tow fibers may be attached to a plate as shown in U.S. Pat. No. 4,145,787. The disposable cleaning article may be used for one job (several square meters of surface) and discarded, or may be restored and re-used for more jobs, then discarded. Traditional cleaning articles including feather dusters, cloths, string mops, strip mops and the like, are not disposable for purposes of this invention.

Such devices may be made, for example, according to U.S. Pat. Nos. 6,813,801; 6,968,591; 6,984,615; 7,228,587; 7,231,685; 7,234,193; 7,234,914; 7,237,296; 7,237,297; 7,243,391; 7302729; 7,302,730; and/or 7,334,287 (having a common related application). The patents in this linage have a common feature—strips laterally extending from both sides of a generally planar article. The strips serve the purpose of increasing surface area of intermediate tow fibers by promoting deformation of the tow fibers out of the plane of the article. This approach has the attendant problem that excessive material is used for the strips. If the strips have the same length, taken from the longitudinal axis, as the tow fibers, the strips can interfere with the tow fibers fully contacting the target surface.

Another problem with a cleaning article comprising strips is that such cleaning articles are typically packaged in a flat state. To get optimum performance, a user should pre-fluff the cleaning article prior to use. Even with instructions, many users simply do not understand how to correctly perform this step. Some users do not read the instructions and entirely skip this step. Furthermore, the strips can be partially joined together due to improper cutting during manufacture, making the fluffing insufficient or more difficult. The problem of strips in such cleaning articles is exacerbated in U.S. Pat. No. 5,953,784 which teaches strips extending not only from both sides of the cloth, but also from the front.

One attempt to overcome this problem is found in U.S. Pat. No. 7,566,671 which does not use laterally extending strips. However, this attempt has the drawback that the cleaning implement thereof only cleans on one side of the implement—not both sides as taught by the lineage of U.S. Pat. No. 6,813,801.

An attempt to overcome the single-sided cleaning disadvantage of the aforementioned U.S. Pat. No. 7,566,671 is found in U.S. Pat. No. 7,251,851 which teaches a spiral duster. However, this approach starts with a construction similar to that of the aforementioned U.S. Pat. No. 6,813,801 lineage and U.S. Pat. No. 823,725—leading the intended solution back to the same approach which started the problem 100 years ago.

Thus, there is a need for a cleaning article which does not require gather strips. Such cleaning article may further provide for advantageous use of the tow fibers to gather and retain dust and may also allow the user to minimize or eliminate the often overlooked or improperly performed fluffing step.

SUMMARY OF THE INVENTION

The invention comprises a cleaning article having a longitudinal axis therethrough. The cleaning article comprises at least one layer of tow fibers. The tow fibers extend laterally outward from proximal ends juxtaposed with the longitudinal axis to distal ends laterally remote therefrom. The tow fiber layer has first and second opposed faces. A generally planar sheet is disposed on the first face of the at least one layer of tow fibers. The sheet has a first face joined to said first face of the layer of tow fibers and a second face opposed thereto.

A panel extends outwardly from at least one of the second face of the layer of tow fibers and/or outwardly from said second face of the generally planar sheet. The panel has a proximal end joined to one of the second faces and extends outwardly to a distal end remote therefrom. An elastic is joined to the panel, elastically contracting said panel.

DETAILED DESCRIPTION OF THE INVENTION

Figure 1:
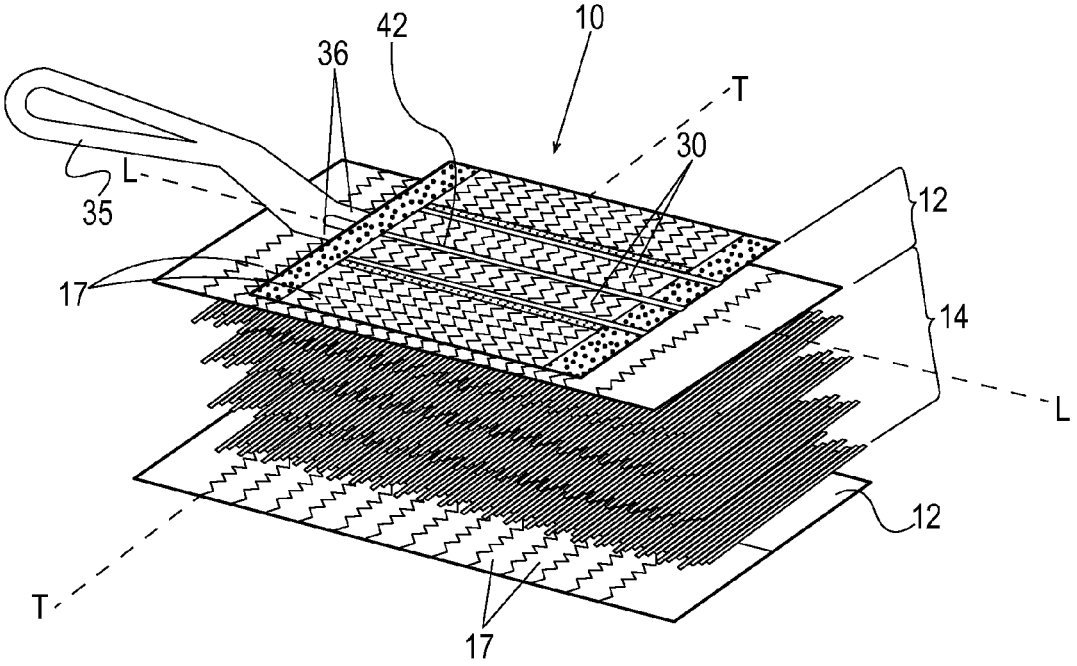
PRIOR ART Fig. 1
FIG. 1 is a schematic exploded perspective view of a cleaning article according to the prior art and having strips.

Referring to FIG. 1, the cleaning article 10 may be generally elongate, having a longitudinal axis L, although other shapes are contemplated and feasible. The cleaning article 10 may be removably attachable to a handle 35 and/or may be used without a handle 35. A suitable handle 35 is disclosed in commonly assigned U.S. Publication 2011/00099764.

The z-direction of the cleaning article 10 is the direction perpendicular to the sheet 12 which is typically closest to the handle (if present) of the cleaning article 10, the XY plane is defined as the plane defined by the sheet 12 and is typically perpendicular to the z-direction. The cleaning article 10 may have a longitudinal axis L and a transverse axis T orthogonal thereto. The cleaning article 10, and respective components thereof, may have two longitudinal edges parallel to the longitudinal axis L and two transverse edges parallel to the transverse axis T.

The length of the cleaning article 10, etc. is taken in the longitudinal direction. The width of the cleaning article 10 corresponds to the transverse direction perpendicular to the length direction and disposed within the plane of the sheet 12. The thickness is defined as the dimension in the z-direction. The length and width of the strips shown in the art are taken in the transverse and longitudinal directions, respectively.

Figure 2:
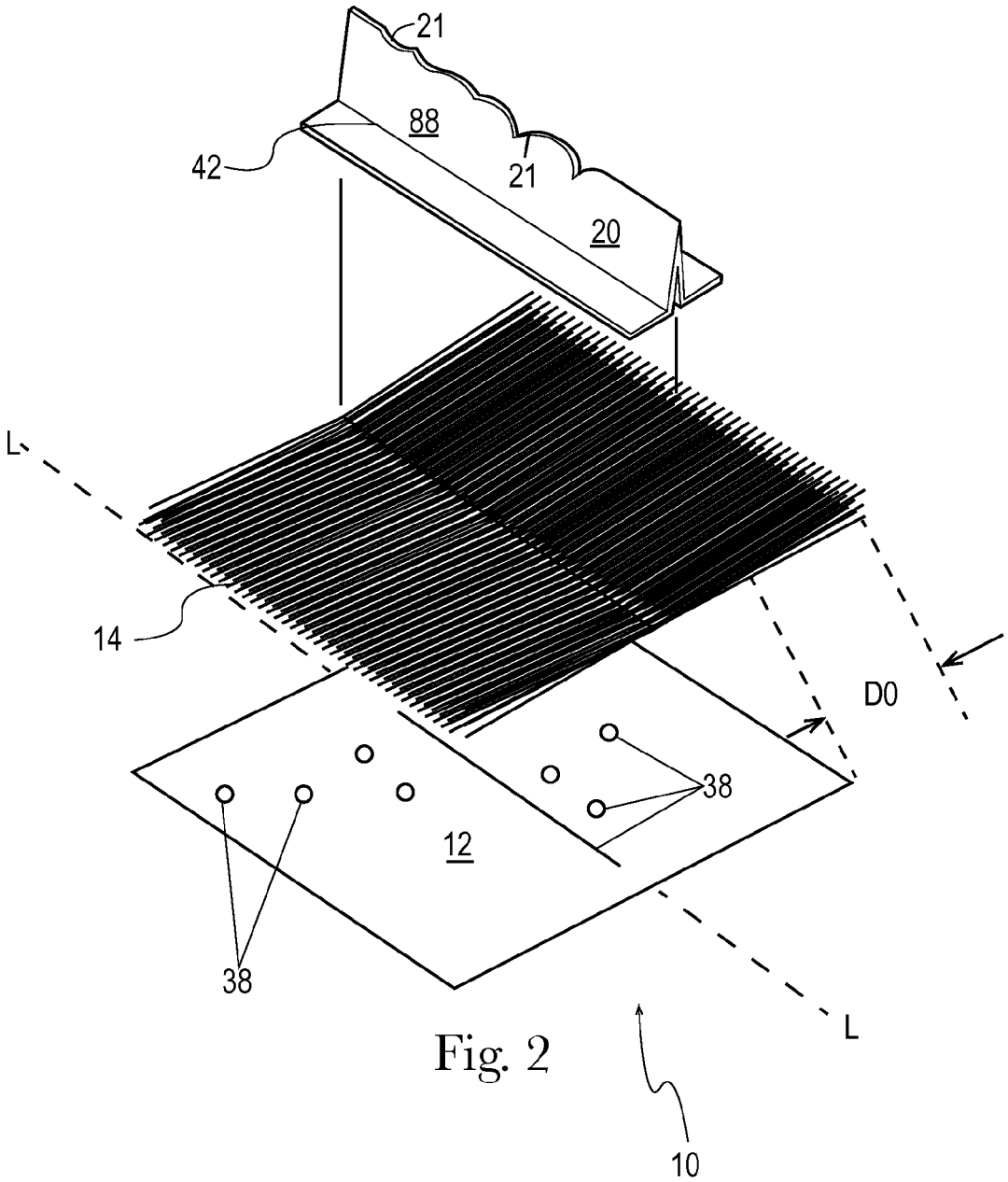
FIG. 2 is a schematic exploded perspective view of a cleaning article according to the present invention and having an elastically contracted panel extending outwardly from one face thereof.

Referring to FIG. 2, the cleaning article 10 may be thought of as having two, three or more laminae 12, 14, joined in face-to-face relationship. The laminae may comprise a tow fiber lamina 14, intermediate two laminae of generally planar sheets 12. Alternatively, a single tow fiber layer 14 may be joined to a single generally planar sheet 12. The tow fiber layer 14 is shown to comprise four layers, although one of skill will understand from one to several layers are feasible and contemplated for use with the present invention. Likewise, one, two, three or more sheets 12 are feasible and contemplated for use with the present invention.

An attachment system may provide for removable attachment of the cleaning article 10 to a suitable and optional handle 35. The cleaning article 10 attachment system and optional complementary handle 35 attachment may comprise adhesive joining, cohesive joining, mechanical engagement, etc. One common attachment system comprises sleeves 30 into which the tines 36 of the handle 35 may be inserted. The sleeves 30 may be disposed on an outer lamina 12.

The sheet 12 may have an outwardly facing preferential cleaning side and a second inwardly facing attachment side opposed thereto. The sheet 12 may comprise a nonwoven sheet 12. Suitable nonwovens may be made according to commonly assigned U.S. Pat. Nos. 6,383,431, 6,797,357; 6,936,330, D489,537 and/or D499,887. Likewise the panel 88 of the present invention may comprise a similar nonwoven sheet 12.

Adjacent the sheet 12 may be a compressible and/or deformable second lamina of fibers 14. The second lamina may comprise tow fibers 14. The tow fiber lamina 14 may be joined to the sheet 12 in face-to-face relationship. The tow fiber lamina 14 may be suitable for directly contacting the target surface during cleaning.

The tow fibers 14 may be synthetic. As used herein "bundle fibers" and/or "tow" refer to fibers comprising synthetic polymers including polyester, polypropylene, polyethylene and cellulose materials including cellulose acetate and mixtures thereof manufactured wherein the individual fibers are relatively long strands manufactured in bundles. The bundle fibers may be defined as any fibers having distinct end points and at least about 1 cm in length. The cleaning article 10 of the present invention may further comprise an optional absorbent core (not shown).

The sheet 12, fibrous layer 14 and panel 88 may be joined together by thermal bonding, autogenous bonding, ultrasonic bonding, heat sealing, adhesive and/or other means known in the art. The sheet 12 may comprise two plies, joined together in face-to-face relationship. The sheet 12, fibrous layer 14 and non-planar structure 16 may be bonded in a pattern which provides a central spine 42 parallel the longitudinal axis L.

The bonding pattern joining the two plies may be provided in a pattern which provides a sleeve 30 complementary to and able to receive the tines of the handle 35, if used with the cleaning article 10 of the present invention. Particularly, the bonding may be provided in a pattern which is generally longitudinally oriented, so that the tines 36 may be inserted into the sleeve 30 created between adjacent bonds.

The joining of the tow fiber layer 14 and generally planar sheets 12 may be done with any combination of continuous bonds 38 and/or spot bonds 38, as known in the art. The bonds 38 may be used to create sleeves 30 for an attachment system as known in the art and discussed herein.

The bond pattern 38 may provide a continuously bonded or discretely bonded central spine 42. Outboard of the central spine 42, the bond pattern may comprise one or more continuous or discontinuous bond sites. The space between the central spine 42 bond and the outboard bonds 38 may create a sleeve 30 for receiving a tine 36 of the optional handle 35. If desired, the sheet 12 may be shrunk/strained in the cross-direction. This process can provide rugosities 21 or wrinkles in sheet 12. The rugosities 21 space apart the plies of sheet 12, allowing for easier insertion of the tines 36 into the sleeve 30, if so desired.

More particularly the cleaning article 10 comprises at least one layer 14 of tow fibers. The tow fibers extend transversely outward from proximal ends juxtaposed with the longitudinal axis L to distal ends transversely remote therefrom. The tow fiber layer 14 has first and second opposed faces. The second face extends outwardly.

A generally planar sheet 12 is disposed on the first face of the at least one layer of tow fibers. The sheet 12 has a first face joined to the first face of the layer of tow fibers and a second face opposed thereto. Again, the second face extends outwardly.

At least one panel 88 extends outwardly from one of said second face of said layer of tow fibers 14 and/or outwardly from said second face of the generally planar sheet 12. A single panel 88 will be discussed below, although one of skill will understand the construction and benefits may be applied to plural panels 88 on a single cleaning article 10. Each panel 88 has a proximal end joined to one of the outwardly facing second faces of the tow fiber layer 14 or sheet 12 and a distal end remote from the proximal end. The proximal end of the panel 88 may be joined to one second face of the cleaning article 10 by thermal bonding, autogenous bonding, ultrasonic bonding, heat sealing, adhesive and/or other means known in the art, as discussed above. The panel 88 may optionally be disposed on the longitudinal axis L of the cleaning article 10, and may be generally or identically parallel thereto.

The panel 88 may have an outward extent, taken perpendicular to the XY plane of the cleaning article 10 as measured from the proximal end to the distal end. A suitable and non-limiting extent may range from 5 to 50 mm. The distal end of the panel 88 need not be rectilinear, as shown. Instead, the distal end of the panel 88 may be irregular, as shown in commonly assigned U.S. 2011/0131746 published Jun. 9, 2011.

An elastic 20 is joined to the panel 88 intermediate the proximal end and distal end of the panel 88. By intermediate it is meant that the elastic 20 may be joined to the panel 88 at any position between or coincident the proximal end and distal end of the panel 88 which allows an operative relationship between the panel 88 and elastic 20. By operative relationship, it is meant that the elastic 20 contracts the panel 88, causing the panel 88 to extend outwardly from the plane of the tow fiber layer 14 or sheet 12.

Suitable elastics 20 may comprise an elastic strand like a rubber band ranging from 0.5 mm to 15 mm. Suitable examples include Fulflex System 7000 available from Fulflex Inc. of Brattleboro, Vt. or Rubber 4141 Soft Stretch Elastic available from Risdon, Spartanburg S.C.

The elastic strands may also comprise an elastomer, such as LYCRA elastomer, available from EI DuPont de Nemours, Wilmington, Del. Individual elastic strands may range from about 470-1500 decitex or about 620-1050 decitex. Other suitable materials are thermoplastic elastomers such as TEX 3CW15 available from Fulflex Inc.

The elastic strands 20 may be of like or different spring rates. It is prophetically believed the different spring rates may cause different contractions to occur in the sheet 12, and thereby improve fluffing. The elastics 20, including elastic strands may be oriented in any of, or combination of, the transverse, diagonal and/or longitudinal directions, to thereby provide contraction in such directions. In one embodiment the elastics 20 may be oriented at ±45 degrees relative to the longitudinal axis L.

Additionally or alternatively, in yet another embodiment, an elastic panel 88 may be made partially, mostly or entirely of the elastic material. This arrangement eliminates the need to attach a separate elastic strand 20 or elastic strip 20 to the panel 88, as such a panel 88 is inherently elastic. If desired, a zero strain elastic 20 may be utilized, as disclosed in commonly assigned U.S. Pat. No. 5,143,679, issued Sep. 1, 1992.

In particular embodiments of the invention the elastics 20 may include a carrier sheet to which elastic strands 20 are attached as grouped set of elastics 20 composed of a plurality of individual elastic strands 20. The elastic strands 20 may intersect, be interconnected or be entirely separated from each other. The carrier sheet may, for example, include a 0.05 mm thick polymer film such as a film of polypropylene sheet material or a non-woven sheet 12 material. In one particular non-limiting embodiment of the invention, 2 to 20 strands may be used with each such elasticized sheet.

In an alternative embodiment the panel 88 may be preconstructed using elastomeric polymer films and/or elastomeric polymers embedded into non-wovens. Suitable examples of such films include elastic materials 20 supplied by Tredegar, of Richmond Va., under the names Flex Feel™, Flex Aire™, Extra Flex™ and Fabri Flex™. Kraton Polymers LLC of Houston, Tex., offers a series of polymers which can be formed into non-woven fabrics to create elastic properties. Suitable polymers are sold under the codes MD6717, MD6705 and G1643.

In yet another alternative embodiment the elastomeric sheets 12 of the cleaning article 10 may be heat shrinkable. Suitable heat shrinkable and/or energy activateable materials could include films such as Vistamaxx™ from ExxonMobil of Irving, Tex.

The heat shrinkable embodiment provides the advantage of incorporating such material during manufacture, then later applying heat to cause the cleaning article 10 to pucker. Such pucker may improve fluffing and resiliency. The heat source may be microwave energy, ultrasonic energy, etc.

The heat may be applied to cleaning article 10 product before it is placed in the packaging. Alternatively a cleaning article 10 may be placed into a package in flat format, and the package sealed. The sealed package may be heated to activate the elastomeric components within the cleaning articles 10 while still in the package. This arrangement provides the advantage of ease of packing in flat form, while contraction and/or puckering within the in box may yield a pre-fluffed format when the cleaning article 10 is removed for use.

While a longitudinally oriented panel 88 having longitudinally oriented elastic 20 is shown, the invention is not limited. The panel 88 may have a longitudinal orientation, transverse orientation, diagonal orientation or combination thereof. For example, a sinusoidal, chevron-shaped, arcuate or other shape may be used for the panel 88. Generally, the proximal end of the panel 88 will determine the overall orientation of the panel 88.

Likewise, the elastic 20 need not be parallel to the XY plane. The elastic 20 may monotonically approach the distal edge of the panel 88. This arrangement prophetically provides the benefit of monotonically increasing/decreasing fluffing of the tow fibers. Alternatively or additionally, the elastic 20 may intercept the distal end of a portion of the panel 88 and be intermediate the proximal end and distal end at other positions. For example, the elastic 20 may represent a sinusoid, having peaks/valleys and/or wavelengths which are identical, similar or different.

Figure 3:
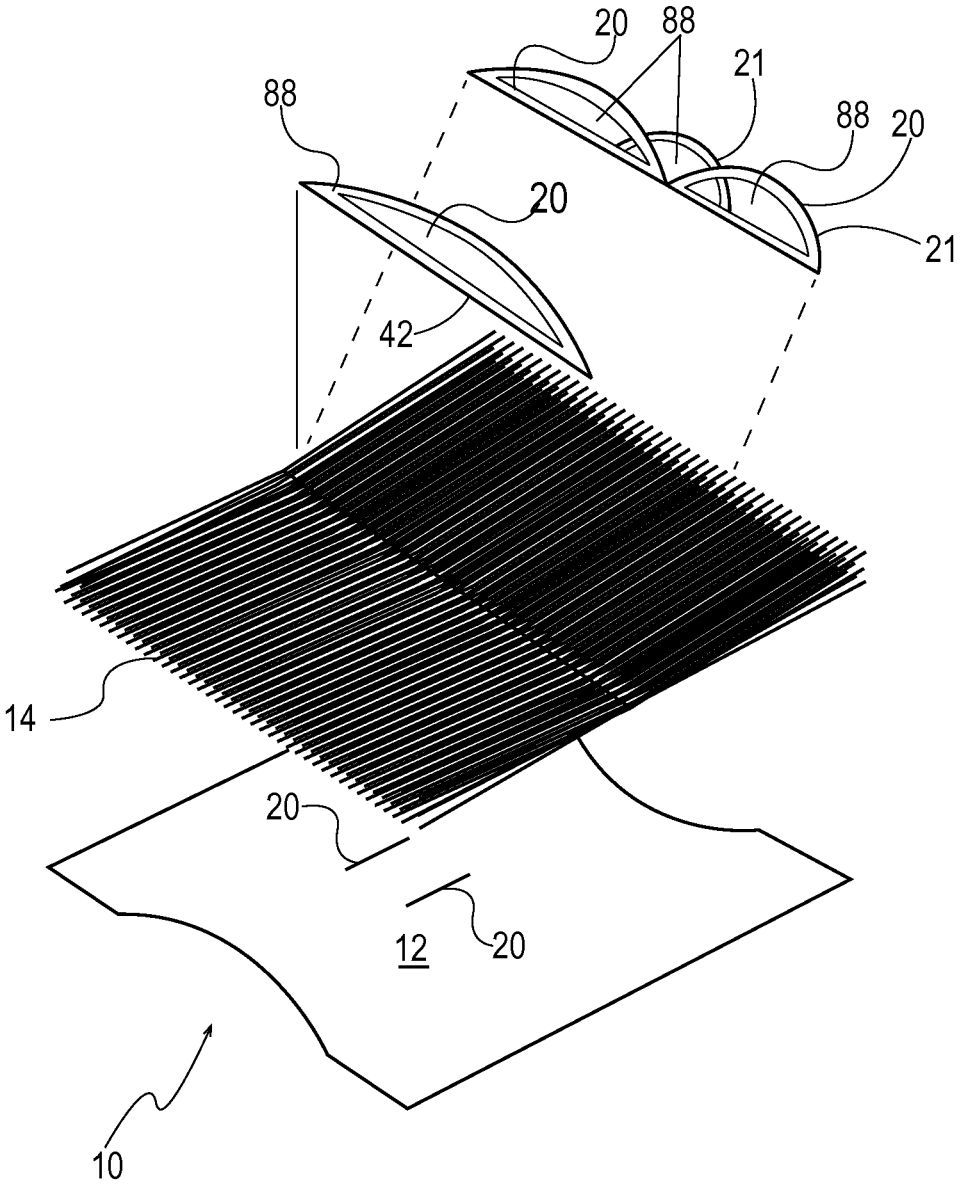
FIG. 3 is a schematic exploded perspective view of a cleaning article according to the present invention and having plural elastic panels extending outwardly from one face thereof and having a sheet with concave longitudinal edges and elastics.

Referring to FIG. 3, the cleaning article 10 may further comprise plural panels 88 extending outwardly from the second face of the layer of tow fibers 14 and/or outwardly from said second face of said generally planar sheet 12. Each outwardly extending panel 88 may have a proximal end joined to one of the respective second faces and a distal end remote therefrom. Some or all of these panels 88 may be elastically contracted, as described above.

The panels 88 of the plurality which are elastically contracted may be alike or different. That is such panels 88 may be of identical, similar or different length, extent outwardly from the proximal end to the distal end, material, stiffness, orientation, etc. With particular reference to the panels which are elastically contracted, such panels may be of identical, similar or different elastic contractions. For example, the elastics may provide have identical, similar or different contractive forces, materials (such as strips vs. strands), lengths (coincident or less than the panel length), positions between the proximal end and distal ends of the panels, etc.

If desired, one or more panels may have plural elastics 20. The elastics 20 may be disposed in series or in parallel on any panel. The plural elastics 20 may be identical, similar or different. For example, the elastics 20 may have identical, similar or different positions, longitudinal lengths, spring rates, contractive forces, materials, etc.

Figure 4:
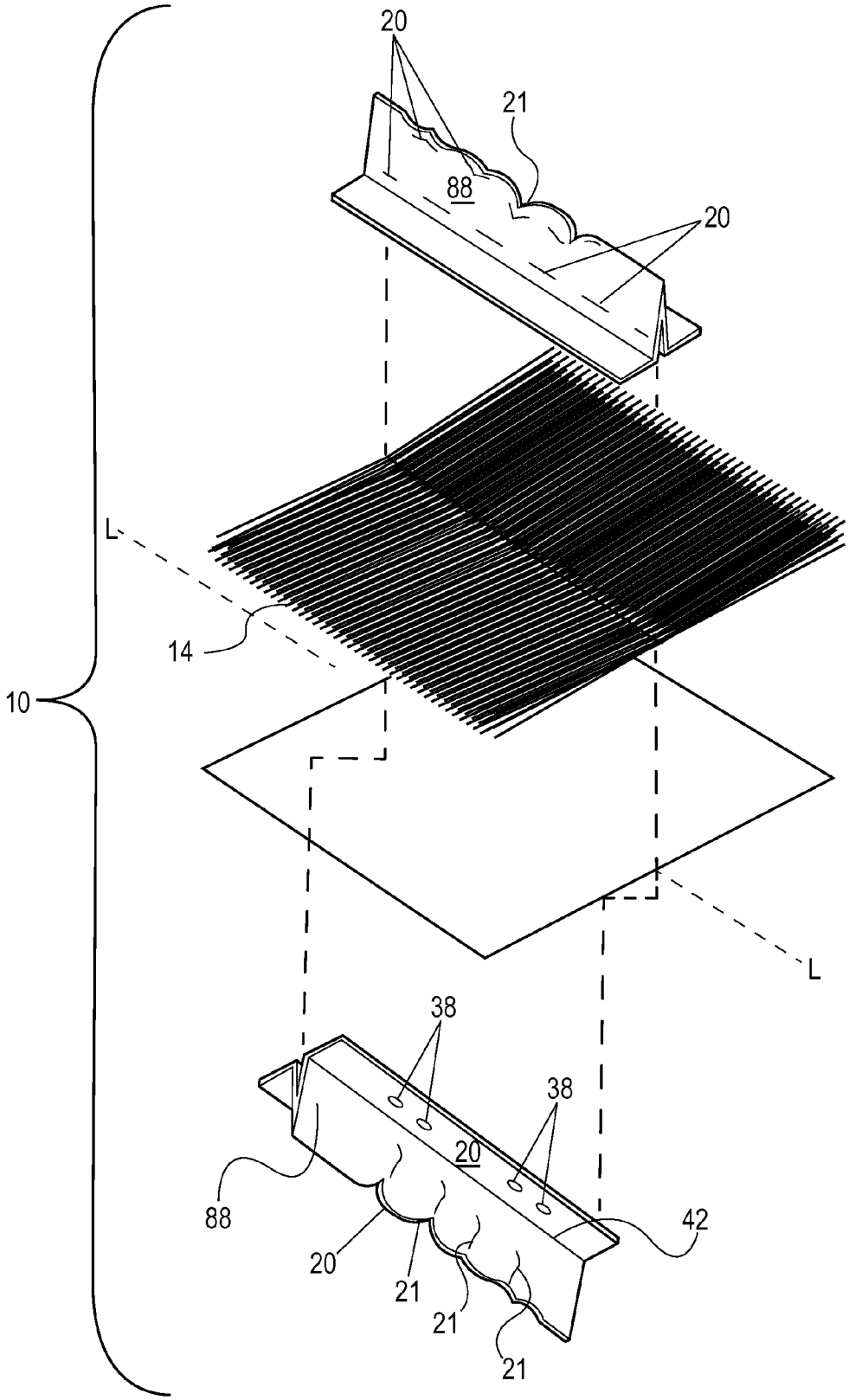
FIG. 4 is a schematic exploded perspective of a cleaning article according to the present invention and having elastic panels extending outwardly from both faces thereof.

Referring to FIG. 4, if desired, the cleaning article 10 may comprise at least one elastically contracted panel 88 extending outwardly from the second face of the layer of tow fibers 14 and may comprise at least one elastically contracted panel 88 extending outwardly from the second face of the generally planar sheet 12. One such second face may have zero, one or plural panels 88 extending outwardly therefrom. The other such second face may likewise have zero, one or plural panels 88 extending outwardly therefrom, which one or more panels 88, may be identical to, similar to or different than the one or more panels 88 on the opposite second face.

If desired the cleaning article 10 may have first sheet 12 and further comprise a second generally planar sheet 12. The second sheet 12 may be interposed between the first face of the first sheet 12 and the layer of tow fibers 14, so that the first sheet 12 and the second sheet 12 are joined in face to face relationship. The first sheet 12 and second sheet 12 may be joined in known fashion to form at least one longitudinally oriented sleeve 30 therebetween for receiving a fork tine 36 therein.

The first sheet 12 may have a respective first sheet 12 longitudinal length. The second sheet 12 may have a respective second sheet 12 longitudinal length. The panel 88 may have a longitudinal length generally equivalent to the first sheet 12 longitudinal length or the second sheet 12 longitudinal length.

If desired, the cleaning article 10 may be used in conjunction with a longitudinally oriented handle 35. The handle may have a grip and at least one tine 36 joined thereto. The at least one tine 36 may be removably inserted to the at least one longitudinally oriented sleeve 30 so that the cleaning article 10 can be manipulated by a user holding the grip. While a handle 35 having two tines 36 are shown, one of skill will understand the invention is not so limited.

The longitudinal tine 36 may serve to maintain the cleaning article 10 in an extended position, despite the contractive force of the elastics 20 on the respective panels 88. The strength of the tine 36 may keep the fiber layer and the sheet 12 longitudinally extended, while the panel 88 is longitudinally contracted. This arrangement allows the panel 88 to extend outwardly from the XY plane, so that the distal end of the panel 88 is free, and may entangle fibers from the fiber layer 14 and/or provide separate wiping action on the target surface.

If desired, the various cleaning articles 10 described herein may be packaged and sold in a kit. One of the cleaning articles 10 may have a single elastically contracted panel 88, and be suitable for one particular cleaning task. Other cleaning articles 10 in the kit may have plural elastically contracted panels 88 and be suitable for other cleaning tasks. This arrangement provides the benefit that the user has a choice of different cleaning articles 10 for different tasks.

Further, any of the embodiments described herein may optionally include any one of, any combination of, or all of: a sheet 12 and/or tow fiber layer 14 having differential overhang DO, a sheet 12 with apertures, an elastically contracted sheet 12 and/or a cleaning article 10 having an elastically contracted upstanding panel 88, as shown in commonly assigned P&G Cases 12382, 12383, 12384 and the instant case, respectively. All such variant embodiments are described in these four aforementioned commonly assigned patent applications, all filed Mar. 9, 2012.

Any of the sheet 12 and/or layer of tow fibers 14 may be completely or partially coated with adhesive, wax, Newtonian or non-Newtonian oils or a combination thereof, in order to improve cleaning and increase retention of absorbed debris. If desired, the cleaning article 10 may optionally be used with a cleaning solution or other solution usable for other purposes such as treating the surface for appearance or disinfectant, etc. The cleaning solution may be pre-applied to the cleaning article 10, creating a pre-moistened cleaning article 10 or may be contained within a separate reservoir for dosing onto the cleaning article 10 and/or target surface. The cleaning solution may comprise a majority water, and at least about 0.5, 2, 5 or 10% solids, or at least about 30% or 50% aqueous solvents, non-aqueous solutions or mixtures thereof (all by weight).

Optionally the cleaning article 10 may further comprise a non-planar structure, as disclosed in commonly assigned U.S. publication 2011/0131746 A1, filed Dec. 4, 2009. The non-planar structure may extend out of the XY plane, in the z-direction.

Referring back to FIG. 1, the cleaning article 10 may optionally further comprise gather strips 17, as known from the prior art. As used herein, gather strips 17 refer to cantilevered elements extending laterally outwardly from the longitudinal centerline of the article 10, and having a length (taken in the transverse direction) greater than the corresponding width (as taken in the longitudinal direction). The gather strips 17 lie within the XY plane as intended by manufacture, although may be deformed out of the XY plane due to fluffing before use, and/or deformations which occur in use due to movement against the target surface. The gather strips 17 may be incorporated into one of the sheets 12, described above or may be deployed on a separate sheet 12.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cleaning article for removable attachment to a handle and having a longitudinal axis therethrough, said cleaning article comprising:

at least one layer of tow fibers, said tow fibers extending laterally outward from proximal ends juxtaposed with said longitudinal axis to distal ends laterally remote therefrom, said layer further having first and second opposed faces;

a generally planar sheet disposed on said first face of said at least one layer of tow fibers, said sheet having a first face joined to said first face of said layer of tow fibers and having a second face opposed thereto;

a panel extending outwardly from one of said second face of said layer of tow fibers or outwardly from said second face of said generally planar sheet; said panel having a proximal end joined to one of said second faces and a distal end remote therefrom; and an elastic joined to said panel intermediate said proximal end and said distal end, said elastic contracting said panel.

2. A cleaning article according to claim 1 wherein said panel extends outwardly from said second face of said layer of tow fibers and outwardly from said second face of said generally planar sheet; each said outwardly extending panel having a proximal end joined to one of said second faces and a distal end remote therefrom.

3. A cleaning article according to claim 2 wherein said outwardly extending panels each has an elastic joined to said panel intermediate said proximal end and said distal end, said elastic contracting said panel.

4. A cleaning article according to claim 1 wherein said generally planar sheet is a first sheet and further comprising a second generally planar sheet, said second sheet being interposed between said first face of said first sheet and said layer of tow fibers, so that said first sheet and said second sheet are joined in face to face relationship, said first sheet and said second sheet being joined to said first sheet to form at least one longitudinally oriented sleeve therebetween for receiving a fork tine therein; and said first sheet having a respective first sheet longitudinal length, said second sheet having a respective second sheet longitudinal length, said panel having a longitudinal length generally equivalent to said first sheet longitudinal length or said second sheet longitudinal length.

5. A cleaning article according to claim 4 wherein said panel comprises plural elastics.

6. A cleaning article according to claim 5 wherein said panel comprises plural elastics having mutually different spring rates.

7. A cleaning article according to claim 6 wherein said mutually different plural elastics are disposed in parallel on said panel.

8. A cleaning article according to claim 4 further comprising a longitudinally oriented handle, said handle having a grip and at least one tine joined thereto, said at least one tine being removably inserted to said at least one longitudinally oriented sleeve so that said cleaning article can be manipulated by a user holding said grip.

9. A cleaning article for removable attachment to a handle and having a longitudinal axis therethrough, said cleaning article comprising:

at least one layer of tow fibers, said tow fibers extending laterally outward from proximal ends juxtaposed with said longitudinal axis to distal ends laterally remote therefrom, said layer further having first and second opposed faces;

a generally planar sheet disposed on said first face of said at least one layer of tow fibers, said sheet having a first face joined to said first face of said layer of tow fibers and having a second face opposed thereto;

an elastically contracted nonwoven panel extending outwardly from said second face of said generally planar sheet.

10. A cleaning article according to claim 9 further comprising an elastically contracted panel extending outwardly from said second face of said layer of tow fibers.

11. A cleaning article according to claim 9 wherein said elastically contracted panel is generally longitudinally oriented.

12. A cleaning article according to claim 9 further comprising a plurality of elastically contracted panels extending outwardly from said second face of said generally planar sheet.

13. A cleaning article according to claim 12 wherein said plurality of elastically contracted panels are generally longitudinally oriented.

14. A cleaning article according to claim 12 wherein said plurality of elastically contracted panels are oriented in mutually different directions.

15. A cleaning article according to claim 14 wherein said elastically contracted panels are symmetric about said longitudinal axis and at least partially diagonally oriented thereto.

16. A cleaning article for removable attachment to a handle and having a longitudinal axis therethrough, said cleaning article comprising:

at least one layer of tow fibers, said tow fibers extending laterally outward from proximal ends juxtaposed with said longitudinal axis to distal ends laterally remote therefrom, said layer further having first and second opposed faces;

a generally planar sheet disposed on said first face of said at least one layer of tow fibers, said sheet having a first face joined to said first face of said layer of tow fibers and having a second face opposed thereto; and wherein said sheet has two longitudinally oriented edges defining a respective sheet width therebetween, and further comprising two longitudinally oriented, elastically contracted panels, one said panel being disposed on each side of said longitudinal axis and being juxtaposed with a respective said longitudinally oriented edge of said sheet.

17. A cleaning article according to claim 16 wherein said sheet has a respective longitudinal sheet length and said layer of tow fibers has a respective longitudinal layer of tow fibers length, said longitudinal sheet length being greater than said longitudinal layer of tow fibers length; and at least one of said elastically contracted panels having a longitudinal length generally corresponding to one of said respective longitudinal layer of tow fibers length and said respective longitudinal sheet length.

* * * * *